United States Patent [19]

Pignataro et al.

[11] 4,157,452

[45] Jun. 5, 1979

[54] ELECTRIC POWER CABLE WITH IMPROVED SCREEN AND METHOD OF MANUFACTURE THEREOF

[75] Inventors: Vincenzo Pignataro; Giovanni Portinari, both of Milan, Italy

[73] Assignee: Industrie Pirelli Societa per Azioni, Milan, Italy

[21] Appl. No.: 829,137

[22] Filed: Aug. 30, 1977

[30] Foreign Application Priority Data

Aug. 30, 1976 [IT] Italy ..... 26648 A/76

[51] Int. Cl.[2] ..... H01B 9/02

[52] U.S. Cl. ..... 174/36; 174/107; 174/115; 156/55

[58] Field of Search ..... 174/107, 36, 106 R, 174/106 SC, 117 R, 117 F, 117 FF, 115; 156/55; 428/114, 295

[56] References Cited

U.S. PATENT DOCUMENTS

| | | | |
|---|---|---|---|
| 3,311,696 | 3/1967 | Melnick | 174/133 R |
| 3,355,545 | 11/1967 | Kilduff | 174/119 R |
| 3,379,821 | 4/1968 | Garner | 174/36 |
| 3,412,200 | 11/1968 | Virsberg et al. | 174/106 |
| 3,435,127 | 3/1969 | Rose | 174/133 R |
| 3,444,024 | 5/1969 | Hillas | 428/295 |
| 3,790,697 | 2/1974 | Buckingham | 174/107 |
| 3,794,750 | 2/1974 | Garshick | 174/107 |
| 3,802,974 | 4/1974 | Emmel | 156/55 |

FOREIGN PATENT DOCUMENTS

| | | | |
|---|---|---|---|
| 2438308 | 2/1976 | Fed. Rep. of Germany | 174/108 |
| 1159428 | 7/1969 | United Kingdom | 174/106 |
| 1200750 | 7/1970 | United Kingdom | 174/108 |

*Primary Examiner*—Arthur T. Grimley

*Attorney, Agent, or Firm*—Brooks, Haidt, Haffner & Delahunty

[57] ABSTRACT

A screen for electric power cables comprising a metal tape with a coating on one side of a thermoplastic with parallel metal wires extending longitudinally of the tape and along non-rectilinear paths partially embedded in the coating and preferably contacting the tape. The tape may also be coated with a plastic on the opposite side with a plastic which will provide good adherence to an insulating sheath. Also, a cable including such screen around the conductor thereof and the insulation on the conductor, and a method for making the screen which comprises heating a so-coated tape, applying the wires to the heated coating in non-rectilinear, parallel paths, pressing the wires into the coating and allowing the latter to cool.

16 Claims, 4 Drawing Figures

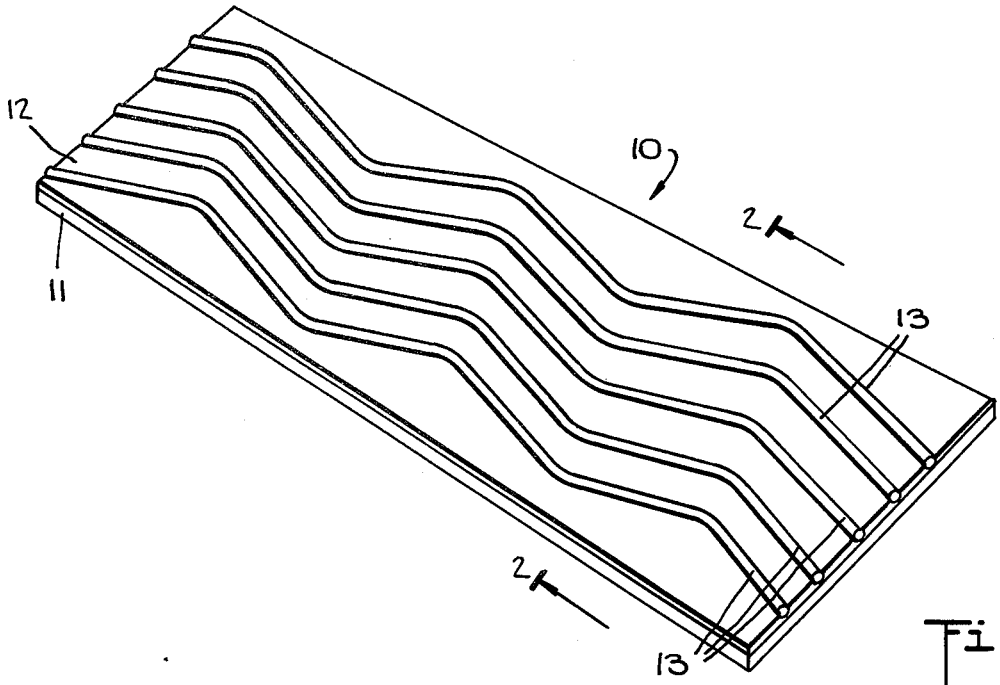
Fig. 1.
Fig. 2.
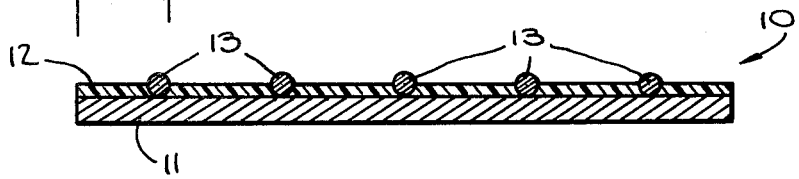
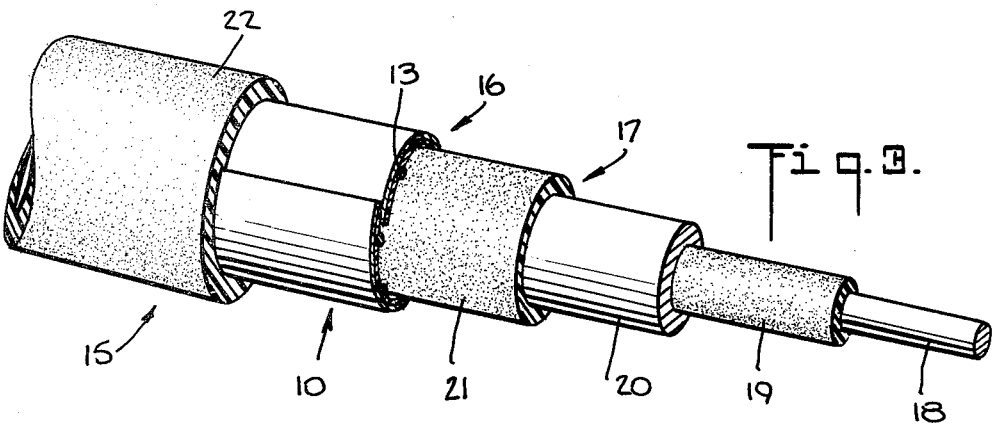
Fig. 3.
Fig 4.
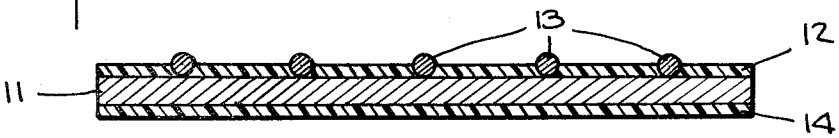

ELECTRIC POWER CABLE WITH IMPROVED SCREEN AND METHOD OF MANUFACTURE THEREOF

The present invention relates to a composite band useful as an electrical screen in electrical power cables, particularly, medium voltage cables (30 kilovolts and upwards) having extruded insulation, to a process for making said band and to a cable including such band.

As it is known, cables having an extruded insulation, especially medium voltage cables, are generally provided with a concentric screen placed around the nucleus. A "nucleus", as used herein, is an element of an indeterminate length comprising at least one conductor, a first semi-conductive layer around the conductor, an extruded layer of insulation of the elastomeric type, e.g., based on a copolymer of ethylene and propylene, terpolymers of ethylene, propylene and diene monomer, etc., or else based on thermoplastics such as polyethylene, polyvinylchloride, etc.

The concentric screen acts as a low electrical resistance path, which is suitable for ensuring the intervention of remedies as soon as any damage to the cable, which makes such intervention necessary, is verified. Among the types of concentric screens used up to now, there is one well-known type of screen comprising tapes and/or copper wires, helically wound around the nucleus.

This latter type of screen turns out to be very costly, not only because of the considerable quantity of expensive materials required, but above all, because of the required subdivisions in the various phases of the production.

As a matter of fact, the presence of the rotating winding heads, necessary for helically winding tapes or wires, could render the application of these tapes or wires in the same production line as the extruder extremely difficult and complex. For a production plant of this type, there would exist the exist the need for providing large capacity accumulators for collecting the cable which continues to issue forth from the extruder even during the period of substituting the collecting bobbins which carry the wires or tapes. This rather complicated system causes one to prefer a more discontinuous process, that is, a process consisting of several more phases, i.e., preparing the nucleus first, and then collecting it on a drum and successively unwinding the nucleus from the drum while helically winding the tapes and/or wires around the nucleus. All this, as is known to those skilled in the art, prolongs the working time and moreover, requires intermediate storing stations for the nucleus-carrying drums.

Also well-known, are concentric screens composed of zig-zag wires, disposed longitudinally on the nucleus; the wires being both parallel and closely spaced one to the other. According to the safety requirements now in force in Europe and set down for instance by the Italian CEI standards or German VDE standards the distance between any adjacent wires has not to be greater than 4 mm, at least as far as 95% of the wires are concerned. As a matter of fact, this distance is difficult to maintain because, during the manufacturing process, the wires tend to shift thereby reducing the length of the finished acceptable product, and because of the wastage, which influences eventually the cost of the finished product, the construction and process are not entirely satisfactory.

The invention has, an one object, the overcoming of hereinbefore described disadvantages, and such object is accomplished by providing a lightweight, flexible screen, which is quite easy to produce, and which can be applied to the cable itself, in a one-step phase, on the same production line as the extruder, the application of a screen to a nucleus as it issues from an extruder being known to those skilled in the telecommunication field.

To be more precise, an object of our invention is a composite band of an indeterminate length, particularly suitable for being used as the concentric screen of a power cable with an extruded insulation, especially, but not exclusively, a screen for medium voltage cables. The band comprises, in combination, a tape of a material of good conductivity with at least one of its surfaces coated with a thermoplastic resin adhering to the tape, a plurality of similar conductor wires equidistant from each other throughout their lengths, or parallel with each of the wires being embedded continuously along the full length of the band in the coating on the tape for a thickness equivalent to at least a part of the diameter of the wires. In the preferred embodiments of said composite band, said thickness is between 10% and 70% of the diameter of each of the said conductor wires. In the most preferred embodiment of the said composite band, said thickness is 50% of the diameter of each of the said conductor wires.

It is also preferred that the said plurality of conductor wires embedded in the coating of thermoplastic resin are in conductive contact with the material of the said tape. Also, it is preferred that the said conductor wires follow nonrectilinear paths on said tape.

A further object of the present invention is a process for making said composite band, which process is characterized by the fact that it comprises the following steps:

(1) Heating said tape with the coating of thermoplastic resin thereon to bring the thermoplastic resin to at least a softening temperature;

(2) Placing the said conductor wires in the desired path configurations on said coating, with each wire being equidistant from each other throughout their lengths, or parallel;

(3) Exerting a pressure on the wires and tape so as to embed each of the conductor wires of said plurality to the desired depth, longitudinally, and continuously along the full length of the band and into the thermoplastic resin on the surface of the tape.

Another object of the present invention, is a single-core or a multi-core power cable, having an extruded insulation, especially, but not exclusively, for use with medium voltages, provided with at least one concentric screen, characterized by the fact that this screen consists of at least one composite band of an indeterminate length constituted as described and applied in a tube shape and longitudinally of the core. In the preferred form of embodiment of the cable, said composite band is applied with the said plurality of the conductor wires on the inside.

Other objects and advantages of the present invention will be apparent from the following detailed description of the presently preferred embodiments thereof, which description should be considered in conjunction with the accompanying drawings in which:

FIG. 1 is a perspective view of a portion of a composite band of the invention;

FIG. 2 is a cross-sectional view of the portion of the composite band illustrated in FIG. 1 and is taken along the line 2—2 shown in FIG. 1;

FIG. 3 is a diagramatic perspective view of a single-core power cable including a composite band of the invention; and FIG. 4 is a sectional view similar to FIG. 2, illustrating a modified form of the composite band.

The composite band 10 shown in FIGS. 1 and 2 is of an indeterminate length, that is, may be as long as it is practical to make the length of the wires and tapes and comprises, in combination, a tape 11 formed out of a metal of good conductivity, preferably aluminum, but any other appropriate metal may serve, e.g., copper, having at least one surface coated with a layer 12 of a thermoplastic resin, e.g., polyethylene, a plurality of the similar conductor wires 13 disposed longitudinally on the said tape 11, the wires 13 being equidistant from, or parallel to, one another. As used herein, the term "similar" means that the wires are of substantially the same cross-sectional dimension and have substantially the same compositon, e.g., made of copper, and preferably, the wires have the same diameter and are identical in composition.

Each of these wires 13 is embedded longitudinally and continuously along the full length of the band, in the thermoplastic resin layer 12 to a depth equivalent to at least part of the diameter of the wire. Preferably, the depth of embedment of said wires 13 is equivalent to between 10% and 70% of the diameter of each of the conductor wires. In one preferred embodiment, this depth is 50% of the diameter of each of the conductor wires 13. It is preferable for the depth or thickness of the layer 12 to be such as to allow the copper wires 13 to come into conductive contact with the tape 11.

The conductor wires 13 illustrated in FIG. 1 are represented as following zig-zig paths, i.e. each path has a plurality of segments extending at angles with respect to each other, but obviously, any other appropriate path slope can be selected, for example, the paths may be undulated, sinusoidal, etc., but preferably, for reasons set forth hereinafter, the paths are not rectilinear.

One preferred combination comprises a tape 11 made of aluminum with a coating 12 of polyethylene and the plurality of wires 13 made of copper. This form of embodiment provides a concentric screen for power cables with an electrical section which meets with the requirements of the Industry Standards Regulations in force, even though there is a low thickness of aluminum for the tape 11, because the aluminum tape 11 becomes integral with the copper wires 13. The thickness of the aluminum tape 11 is, preferably, between 0.15 mm and 0.2 mm, with the sections and the distribution of the copper wires 13 depending on the cable diameter, and upon the requirements of the user.

It is preferable, but not necessary, for the diameter of the copper wires 13 to be between 0.1 mm and 1 mm, while the thickness of the coating 12 should preferably, but not necessarily, be greater than half the diameter of the said copper wires 13. The screen thus obtained is highly flexible and lightweight, and in addition, is economical as compared to other copper wire screens used to date.

The composite band 10 may be manufactured by quite a simple process. The tape 11 with the coating 12 thereon is heated so as to bring the thermoplastic resin up to at least its softening point temperature. Simultaneously, there is disposed on the surface of the coating 12 a plurality of conductor wires 13 in the desired path configurations, each wire being equidistant from, and parallel to, the other, and extending longitudinally of the tape 11. Pressure is now applied to the wires 13 and the tape 11, so as to embed the plurality of the said wires 13 in the thermoplastic resin coating 12 until the desired depth of embedment is obtained continuously along the full length of the tape 11.

The composite band 10, obtained thus, is now left to cool down to a temperature lower than the softening point of thermoplastic resin. After this, the composite band 10 is ready for being used or for being collected onto bobbins for storage. Of course, it will be apparent that the band 10 may be made by continuously moving the tape 11 with the coating 12 thereon in the longitudinal direction while heating the coating 12, continuously feeding the wires 13 on the coating 12 and, continuously pressing the wires 13 into the coating 12 after they are applied thereto.

In FIG. 3, there is illustrated a single-core power cable 15, for example, a medium voltage cable, in which a concentric screen 16 is made of the composite band 10 applied in a longitudinal tube shape around the nucleus 17, the edges of the band 10 being overlapped. This nucleus 17 comprises at least one conductor 18; one first semi-conductive layer 19; one extruded insulating layer 20 of a polymeric material, such as, for example, ethylene propylene rubber, or a thermoplastic polymer; and a second semi-conductive layer 21.

The invention is also applicable to multi-core cables, i.e., polyphase cables, each core or phase being surrounded by a concentric screen 16.

The concentric screen 16, which is formed from the composite band 10 of the FIGS. 1 and 2, is applied with the copper wires 13 on the side of the tape 11 which faces toward the inside of cable 15, and as a consequence of this, the aluminum tape 11 is on the outside of the wires 13.

The fact that the length of wires 13 following paths other than rectilinear, e.g. zig-zag, undulating or sinusoidal, etc., is greater than the tape 11 length, allows for the wires 13 themselves to remain unstressed if there are excessive tension or bending stresses when the cable 15 is layed along curved paths.

On the concentric screen 16, there is an extruded sheath 22, preferably of an insulating thermoplastic material.

In a still further preferred embodiment, the outwardly facing surface of screen 16, i.e., the side facing towards the sheath 22, is also coated with a coating or layer 14 as shown in FIG. 4. Said coating is made of materials treated specially for adhering to the material of the sheath 22, so as to bond it to the concentric screen 16. For example, for a polyethylene sheath 22, the coating 14 of the external surface of the screen 16 preferably should be of polyethylene and for a polyvinyl chloride sheath 22 the coating 14 should be polyvinyl chloride. However, this does not exclude any other material, different from the material of the sheath 22, as long as the purpose of adhering the concentric screen 16 to the sheath 22 is achieved.

The longitudinal application of the composite band 10 around the nucleus 17 of the cable 15 (see FIG. 3) for forming the concentric screen 16, by not requiring rotating means, as with the helical winding of tapes, turns out to be extremely simplified with respect to the application around the nucleus 17 of concentric screens formed of helically wound tapes, as has been used until now for power cables. The longitudinal application of the composite band 10 around the nucleus 17 of cable 15 can take place on the same extrusion line in which the insulation and the sheath are extruded on the cable in the manner generally known to those skilled in the art of manufacturing telephone cables.

In other words, the conductor 18 will pass through a first extruder head which will extrude the layers 19, 20, 21 thereon. On the nucleus 17, as it is thus formed, will be longitudinally applied the composite band 10. Simultaneously, a forming device provides for shaping the band 10 into a tube-shape, for forming the concentric screen 16. The nucleus 17, provided with the screen 16, then passes through a second extruder head which extrudes the sheath 22 thereover.

Neither the line comprising the first and the second extruder heads, nor the band forming machine, have been illustrated since they are well-known in the art.

Although preferred embodiments of the present invention have been described and illustrated, it will be apparent to those skilled in the art that various modifications may be made without departing from the principles of the invention.

What is claimed is:

1. A composite screen for electric power cables comprising a relatively long and narrow metal tape having an adherent coating of a thermoplastic resin on at least one surface thereof with a plurality of spaced, separate, individual and similar metal wires which are without intermediate electrical conductors conductively interconnecting said wires transversely of their lengths and which are incompletely embedded in said coating so that in its flat, free state part of the surface of each wire facing away from said tape extends above the adjacent surface of said coating and is free of insulating material and exposed for conductive contact with an adjacent conductor, said wires being closely spaced and parallel to each other, extending lengthwise of said tape, and being distributed across and within the width of the tape.

2. A screen as set forth in claim 1 wherein said wires are embedded in said coating to a depth which is from 10% to 70% of the diameter of said wires.

3. A screen as set forth in claim 2 wherein wires are of the same diameter and said depth is 50% of said last-mentioned diameter.

4. A screen as set forth in claim 1 wherein said wires are also in contact with said tape.

5. A screen as set forth in claim 1 wherein said tape is made of aluminum.

6. A screen as set forth in claim 5 wherein said thermoplastic resin is polyethylene.

7. A screen as set forth in claim 6 wherein said wires are made of copper.

8. A screen as set forth in claim 1 wherein said wires are equidistant from each other throughout their lengths and follow paths which are non-rectilinear.

9. A screen as set forth in claim 8 wherein each of said paths comprises a plurality of segments at angles with respect to each other.

10. A screen as set forth in claim 8 wherein each of said paths are sinusoidal.

11. A composite screen as set forth in claim 1 wherein said surface of said coating is non-adhesive.

12. An electric power cable comprising at least one core, each said core comprising a conductor surrounded by insulation, a tubular screen around each said core and concentric with said conductor, each said screen comprising a metal tape with an adherent coating of a thermoplastic resin on at least one surface thereof and a plurality of separate, individual and spaced wires which are without intermediate electrical conductors conductively interconnecting said wires transversely of their lengths and which are incompletely embedded in said coating so that part of the surface of each wire facing away said tape extends above the adjacent surface of said coating and is free of insulating material and exposed for conductive contact with an adjacent conductor, said wires extending longitudinally of said tape and along spaced parallel paths, a layer of semi-conductive material extending around said conductor and adjacent and in conductive contact with the exposed surfaces of said wires, and an external sheath of insulating material.

13. A cable as set forth in claim 12 wherein said wires are on the surface of said screen which faces said conductor.

14. A cable as set forth in claim 13 further comprising a coating of a plastic material on the surface of said tape opposite to the surface thereof carrying said wires, said last-mentioned material being in contact with and adhering to the material of said sheath.

15. A process for manufacturing a composite screen for electric power cables which comprises a metal tape with a coating of a thermoplastic resin with parallel wires incompletely embedded in the coating and free of insulation at the side thereof facing away from said tape, said process comprising heating a metal tape with a coating of a thermoplastic resin adhering to one surface thereof until the coating reaches at least the softening temperature, applying a plurality of unconnected spaced metal wires to said coating with the wires extending longitudinally of the tape and along parallel paths equidistant from each other, engaging and pressing the wires into the coating until they are embedded to a depth less than the dimension of the wires in a direction perpendicular to the tape so that part of the surface of each wire is not covered by the coating and permitting the coating to cool.

16. A method as set forth in claim 15 wherein said wires are applied to said coating in a non-rectilinear pattern.

* * * * *